US005104616A

United States Patent [19]

Bäckerud et al.

[11] Patent Number: 5,104,616

[45] Date of Patent: Apr. 14, 1992

[54] METHOD FOR PRODUCTION OF MASTER ALLOYS FOR GRAIN REFINING TREATMENT OF ALUMINUM MELTS

[75] Inventors: Lennart Bäckerud, Lidingö; Rein Kiusalaas, Hägersten; Hans Klang, Södertälje, all of Sweden; Mattheus Vader, Zuidlaren, Netherlands; Jan Noordegraaf, Haren, Netherlands; Edward H. K. Nagelvoort, Farmsum, Netherlands

[73] Assignee: Backerud Innovation AB, Lidingo, Sweden

[21] Appl. No.: 435,520

[22] PCT Filed: May 19, 1988

[86] PCT No.: PCT/SE88/00258

§ 371 Date: Jan. 16, 1990

§ 102(e) Date: Jan. 16, 1990

[87] PCT Pub. No.: WO88/09392

PCT Pub. Date: Dec. 1, 1988

[30] Foreign Application Priority Data

May 22, 1987 [SE] Sweden ..... 8702149

[51] Int. Cl.[5] ..... C22C 1/02

[52] U.S. Cl. ..... 420/552; 75/680; 75/683

[58] Field of Search ..... 420/552; 75/680, 683

[56] References Cited

U.S. PATENT DOCUMENTS

| | | | |
|---|---|---|---|
| 4,060,411 | 11/1977 | Goto et al. | 75/684 |
| 4,812,290 | 3/1989 | Sigworth | 420/552 |
| 4,842,821 | 6/1989 | Banerji et al. | 420/552 |

*Primary Examiner*—Melvyn J. Andrews
*Attorney, Agent, or Firm*—Young & Thompson

[57] ABSTRACT

A method for the production of master alloys intended for grain refining of aluminum melts and being of the type which comprises of aluminum and 1–15 percent by weight titanium, where titanium is present in the form of intermetallic crystals of titanium aluminide in combination with additives of carbon and/or nitrogen. The method is characterized by adding carbon and/or nitrogen to the aluminum melt in an amount corresponding to at least 0.01 percent by weight in the resultant solidified material. The addition of the carbon and/or nitrogen is effected in elemental form or in the form of dissociable carbon and/or nitrogen containing compounds, making said addition before of during an established thermodynamic state of dissolution of existing crystals of titanium aluminide, and bringing the melt into a thermodynamic state where crystals of titanium aluminide present grow in size and thereafter causing the melt to solidify. Also a master alloy produced according to the above method is claimed.

1 Claim, No Drawings

METHOD FOR PRODUCTION OF MASTER ALLOYS FOR GRAIN REFINING TREATMENT OF ALUMINUM MELTS

The present invention concerns both a method for manufacturing a master alloy to be added to aluminum melts in order to obtain a grain refining effect in cast products of aluminium and the resultant master alloy as such.

It is well known that when casting aluminium the molten metal must have certain sufficient crystal nuclei to obtain the desired grain size of the cast products. It is often necessary to increase the number of crystal nuclei through additions to the melt. This is usually achieved by adding to the melt a master alloy containing a very large number of nucleating particles, which disperse in the aluminium melt.

Titanium is the most common additive for grain refining of aluminium, and also a very efficient additive in this regard. At normal melting and casting temperatures, titanium concentrations above 0.2% form with aluminium the intermetallic phase $Al_3Ti$, although lower concentrations will also give a grain refining effect. In the production of a master alloy containing 1-15% Ti in aluminium, particles of $Al_3Ti$ form together with some Ti in the solution, in accordance with generally accepted phase diagrams. It has also been discovered that an addition of boron to master alloys containing Ti will considerably improve the grain refining effect, especially when the Ti/B ratio is higher than 2.2. Boron forms particles of the type $TiB_2$ which are assumed by some researchers to constitute crystal nucleation sites, while others claim that boron causes a decrease in the $Al_3Ti$ dissolution rate in the aluminium melt, and thereby creates a more effective and durable grain refining action in which the intermetallic phase $Al_3Ti$ is involved. This behaviour is considered to be further enhanced when the boride particles develop in intimate contact with the $Al_3Ti$-crystals (R. Kiusalaas "Relation between Phases present in Master Alloys of the Al-Ti-B type, Chemical Communications, University of Stockholm, 1986, No. 1).

It has been noted, however, that the addition of boron to aluminium causes certain disadvantages, due to the formation of hard boride particles; therefore, it is often desired to avoid boron in special-duty aluminiums, e.g. when producing material for beverage cans and for foil.

Therefore, efforts have been made to replace boron by other elements. Thus, from WO 86/05212 it can be seen that efforts have been made to produce a master alloy by introducing at least 0.1 and preferably around 1% of carbon as graphite powder into a titanium-rich aluminium melt to form a large number of TiC-particles, which by the inventors are considered to constitute active nucleation sites for aluminium. This basic idea was published by A. Cibula, J. Inst. Metals, 1949-50, 76, pp. 321-359, who, however, recognized the difficulties in introducing large amounts of carbon into aluminium, a problem which the inventors claim to have solved. The use of a master alloy containing $\geqq 1\%$ carbon in the form of TiC-particles does not, however, lessen the negative effect caused by the presence of hard particles in the final product.

Cibula made his observation in diluted melts (aluminium alloy melts, ready to cast) where the amount of transition elements, like titanium, was below the concentration at which an aluminide phase (in the actual case $Al_3Ti$) could form.

Some years later (1957 DE-B-10 27 407), the problem was solved by introducing carbon into aluminium melts via a gas stream containing hydrocarbons or a chlorinated hydro-carbon, on the basis of Cibula's observations.

The grain refining treatment was performed on diluted melts (ready to cast) at temperatures $<800°$ C. where the titanium concentration was below 0.2% Ti and hence $TiAl_3$-particles were not present. Carbon and/or boron was added in amounts such as to quantitatively transform all titanium in the melt to carbides and/or borides, in accordance with the object of the treatment. The use of $N_2$ as a carrier gas was not considered to influence the intended reaction.

The present invention is based on the understanding that the grain refining mechanism is a combined action of nucleation and subsequent growth of aluminium crystals. In high alloyed systems and at high cooling rates, the growth undercooling is usually large enough to bring about nucleation and growth of new crystals on heterogeneous nuclei present in the melt.

In order that grain refinement is also effective for the production of commercial pure and low-alloy aluminium types, it has been found that formation of a new crystal must take place in a "growth centre", where nucleation occurs somewhat above the bulk liquidus temperature, and the nucleation event is immediately followed by growth in a constitutionally favourable environment which, in the case concerned, can be realized if a source of titanium is available locally to stabilize the new crystal. (Bäckerud et al "Solidification Characteristics of Aluminium Alloys" Scanaluminium (1986)).

In commercially pure and low-alloyed aluminium growth centers can, for example, be obtained around a titanium-aluminide particle, where titanium is able to supply, through diffusion, sufficient titanium to stabilize the new aluminium crystal relative to the surrounding bulk liquid (Klang "Grain Refinement of Aluminium by Addition of Al-Ti-B Master Alloys", Chemical Communications, University of Stockholm, 1981, No. 4).

This stabilizing effect cannot be achieved if nucleation takes place on solely dispersed boride or carbide particles.

Although such particles are themselves thermodynamically stable, their surroundings are probably depleted in titanium, and therefore no positive constitutional effect for growth of a nucleated alpha-aluminium crystal exists.

It has now been discovered that an intimate mix of titanium aluminide and titanium-carbide, nitride or carbonitride particles can constitute such "growth centres".

The present invention describes methods for producing such "growth centres" in a master alloy, by adding minimum amounts of such elements as carbon perse or carbon in combination with nitrogen, to a titanium-rich aluminium melt, to provide a master alloy with high grain refining efficiency and a minimum content of "hard" particles.

The invention relates to a method for producing master alloys intended for grain refining of aluminium melts and being the type which comprises of aluminium and 1-15 percent by weight titanium, where titanium is present mainly in the form of intermetallic crystals of $Al_3Ti$ in combination with additives of carbon and/or nitrogen, characterized by adding carbon and/or nitrogen to the aluminium melt in an amount corresponding to at least 0.01 percent by weight in the resultant solidified material, adding the carbon and/or nitrogen in elemental form or in the form of dissociable carbon and/or nitrogen containing compounds, making said addition before or during an established thermodynamic state of dissolution of existing crystals of titanium aluminide, and bringing the melt into a thermodynamic state where crystals of titanium aluminide present grow in size and thereafter causing the melt to solidify. Hence, the deleterious consequences of a large quantity of hard particles are considerably reduced.

The respective amounts of carbon and nitrogen retained by the master alloy amount to 0.01-0.2 percent by weight only. The formation of $Al_3Ti$ particles in the melt and their number and size are controlled in accordance with earlier knowledge concerning the production of binary Al-Ti-master alloys. The size, number and morphology of the particles are controlled via the manufacturing process. For example, the reduction of titanium salts at low temperature, 700°-800° C., creates a large number of small, compact crystals, while the addition of metallic titanium at high temperatures, 1000°-1200° C., creates a smaller number of larger flake crystals. Holding times and cooling rates are also important for the particle formation. (Arnberg et al, Met. Technol.:9 (1982)).

Carbon and nitrogen can be added to the melt in elementary form or via a gas stream in the form of compounds which are dissociable at the temperature of the melt, among which hydrocarbons can be mentioned. Nitrogen can also be used as carrier gas and, in that way, dilute the hydrocarbon gas. The hydrogen surplus can be removed from the melt at the same time by the bubbling through the nitrogen gas.

In addition to nitrogen gas, ammonia ($NH_3$), hydrazin ($N_2H_2$), possibly mixed with nitrogen gas ($N_2$), can also be used as a nitrogen source. Carbon can also be added in the form of other compounds, which compounds are decomposed in liquid aluminium or are added in the form of a dispersed salt, which is introduced into the metal melt. This also applies to nitrogen compounds.

It is also possible to use e.g. a double salt containing both C and N, for example calcium cyanamide, $CaCN_2$, and other dissociable carbon- and nitrogen-containing compounds can be used, which are added to the melt.

The low addition levels of at least 0.01 percent by weight of retained carbon and/or nitrogen in the solidified alloy do not encounter such difficulties as are the subject matter of WO 86/05212. The maximum content is 0.2 percent by weight of each of carbon and nitrogen. The content of added carbon and/or nitrogen in the solidified material is preferably, in each case, at least 0.05 percent by weight and the retained content of carbon and nitrogen together is preferably lower than 0.2 percent by weight in the solidified material.

The introduction of carbon and nitrogen together into the melt leads to the formation of titanium compounds of these elements, such as titanium carbide and titanium carbonitride.

The formation of titanium carbide, titanium nitride and titanium carbonitride ($TiC_xN_{1-x}$, where x is from 0 to 1), is contingent on the titanium concentration. The free energy is lower for titanium carbonitride than for titanium nitride and titanium carbide and is thus preferred.

Hence, the methods of adding Ti, C or N as such are well known and also the use of $N_2$ as a carrier gas to facilitate introduction of reactants and to stir metal melts and possibly also by flotation principles remove sludge particles.

In order for such compounds to be preferentially precipitated at the surface of the $Al_3Ti$-crystals, the titanium activity should be higher here than in the bulk-liquid.

This can be obtained in an efficient way if C and N are added to the binary AlTi-alloy during heating of the alloy melt. The $Al_3Ti$-particles undergo partial dissolution; a diffusion zone enriched in Ti arises in which carbide and carbonitride formation will occur preferentially.

The temperature increase should lie between 10°-400° C. and with a rate of 1°-30° C./min$^{-1}$.

The temperature variation of the melt should lie within a temperature range of 800° to 1200° C. and the increase in temperature increase is suitably from 50-300, preferably 100°-150° C. The total time taken to effect the increase is preferably 6 to 60 minutes.

According to the invention, it is desirable that the agglomeration of carbide/carbinitride-crystals, which are formed at the surface of the $Al_3Ti$-particles, becomes incorporated in the $Al_3Ti$-phase. This can take place as the $Al_3Ti$-particles grow in size and expand to envelope the carbide/carbonitride particles.

Isothermally this can be done through growth of certain $Al_3Ti$-crystals at the expense of others; the so-called "Oswald ripening", or still more efficiently, at the same time more Ti is added to the melt.

It is possible to obtain a suitable isothermal thermodynamic condition according to the invention by changing the titanium concentration by addition of titanium together with the addition of carbon or carbon and nitrogen intermittently and repeatedly e.g. by increasing the titanium content from 8 to 12 percent by addition of several quantities of titanium every 5-15 minutes together with simultaneous addition of carbon or carbon and nitrogen.

The growth of $Al_3Ti$-crystals occurs of course faster when the temperature is allowed to decrease, since the solubility of titanium in the melt is lowered thereby. A suitable temperature reduction lies between 10°-300° C., with a cooling rate of more than 1° C./min. Furthermore, additional C and N can be supplied during this temperature reduction.

A third possibility of increasing the growth of $Al_3Ti$-crystals is one of adding more titanium to the master alloy. This can, for example, be done through the introduction of titanium compounds, such as titanium chloride via a carrier gas. This will result in the formation of chlorine gas; which reduces the amount of hydrogen in the melt. This obviates the need to make a separate addition of, for example, $C_2Cl_6$ for reduction of hydrogen content.

The master alloy can be subjected to several alternating cycles of various thermodynamic states, comprising alternating dissolution and growth of crystals of titanium aluminide. The addition of carbon and/or nitrogen may be effected during more than one of the cycles.

The reaction temperature and holding times for isothermal treatment, cooling rate to casting temperature, rate of temperature increase and cooling rate during treatment in thermal cycling processes, titanium content, and the amounts of added carbon and nitrogen control the structure formation its grain of the master alloy and refining properties when added to aluminium melts before casting. Thus, it is possible to regulate the properties of the compounds with the aid of several parameters, based on theoretical grounds and according to practical experiments. In this way, it is possible to produce a number of different qualities of the master alloy depending on the needs of the market.

EXAMPLE

In a series of tests performed, it has been found that:

When diluted to 0.01% Ti in the melt to be refinded, a binary Al 10% Ti-master alloy gives a typical grain size of 400-500 um.

After treatment according to the present invention, with retained amounts of C=0.19% and N=0.11%, the grain size diminishes to 280 um and at an addition rate of 0.02% Ti, to values between 160-190 um.

We claim:

1. A method for the production of master alloys intended for grain refining of aluminum melts, the master alloy consisting essentially of aluminum and 1-15 per cent by weight titanium, where titanium is present in the form of intermetallic crystals of titanium aluminide in combination with additives of carbon and/or nitrogen, comprising adding carbon and/or nitrogen to a molten aluminum melt in an amount corresponding to 0.01-0.2 per cent by weight in the resultant solidified material; adding the carbon and/or nitrogen in elemental form or in the form of dissociable carbon and/or nitrogen containing compounds, making said addition before or during increasing the temperature by 10°-400° C. within the range 400°-800° C. with a temperature increase rate of 1°-30° C. min.$^{-1}$ with a total time for the temperature increase of 6 to 60 minutes, and thereafter causing crystal growth of the titanium aluminide phase by lowering of the temperature 10° to 400° C. with a cooling rate of more than 1° C. min.$^{-1}$, whereby particles of titanium aluminide grow and envelop formed titanium carbide/nitride/carbonitride particles.

* * * * *